US006175994B1

(12) United States Patent
Nicoletti

(10) Patent No.: US 6,175,994 B1
(45) Date of Patent: Jan. 23, 2001

(54) DEVICE FOR ADJUSTING AND CLAMPING THE TOOTHED STRAP OF A FASTENING FOR SPORTS FOOTWEAR

(75) Inventor: Graziano Nicoletti, Treviso (IT)

(73) Assignee: Bauer Italia S.p.A., Treviso (IT)

( * ) Notice: Under 35 U.S.C. 154(b), the term of this patent shall be extended for 0 days.

(21) Appl. No.: 08/866,410

(22) Filed: May 30, 1997

(51) Int. Cl.[7] ..... A43C 11/00

(52) U.S. Cl. ..... 24/68 SK; 24/70 SK; 24/71 SK; 36/50.1

(58) Field of Search ..... 24/60 SK, 69 SK, 24/70 SK, 71 SK, 71.1, 712.2, 712.3, 713.5; 36/50.5, 50.1

(56) References Cited

U.S. PATENT DOCUMENTS 4,765,069 * 8/1988 Baggio et al. ..... 24/68 SK X
4,796,337 * 1/1989 Marxer ..... 24/68 SK
5,172,454 * 12/1992 Martignago ..... 24/68 SK
5,416,952 * 5/1995 Dodge ..... 24/68 SK X
5,575,045 * 11/1996 Chu ..... 24/68 SK
5,606,779 * 3/1997 Lu ..... 24/68 SK
5,654,555 * 8/1997 Lin ..... 24/68 SKS

* cited by examiner

*Primary Examiner*—Anthony Knight
*Assistant Examiner*—Robert J. Sandy
(74) *Attorney, Agent, or Firm*—Sughrue, Mion, Zinn, Macpeak & Seas, PLLC

(57) ABSTRACT

A device for adjusting and clamping the toothed strap of a fastening for sports footwear comprises a base, a stopping ratchet mechanism with a first lever for engaging the teeth of the strap in order to stop it, and an advancing ratchet mechanism with a second lever for engaging the teeth of the strap in order to advance it, in which the second lever of the advancing ratchet mechanism is articulated to the first lever of the stopping ratchet mechanism.

17 Claims, 10 Drawing Sheets

DEVICE FOR ADJUSTING AND CLAMPING THE TOOTHED STRAP OF A FASTENING FOR SPORTS FOOTWEAR

BACKGROUND OF THE INVENTION

The present invention relates, in general, to a fastening designed particularly for ski boots, skates and similar sports footwear.

In particular, the present invention relates to a device for adjusting and clamping the strap of a fastening of the aforementioned type.

SUMMARY OF THE INVENTION

The main object of the present invention is to provide a device for adjusting/clamping the toothed strap of a fastening of the type in question having structural characteristics which make it particularly compact so that it occupies little space on the shell of a ski boot, is easy to grip, and is equally easy for the user to manipulate, as well as functional characteristics such as to ensure fine adjustment of the fastening tension, even under load, as well as very reliable clamping of the strap, and hence of the fastening, at the desired tensioning value.

These objects and others which will become clearer from the following description are achieved by a device for adjusting/clamping the strap of a fastening of the type in question which has the characteristics defined precisely in the following claims.

BRIEF DESCRIPTION OF THE DRAWINGS

The characteristics and advantages of the invention will become clearer from the detailed description of an embodiment of an adjustment/clamping device according to the invention, given with reference to the appended drawings, provided by way of non-limiting example, in which.

DETAILED DESCRIPTION OF THE INVENTION

Figure 1:
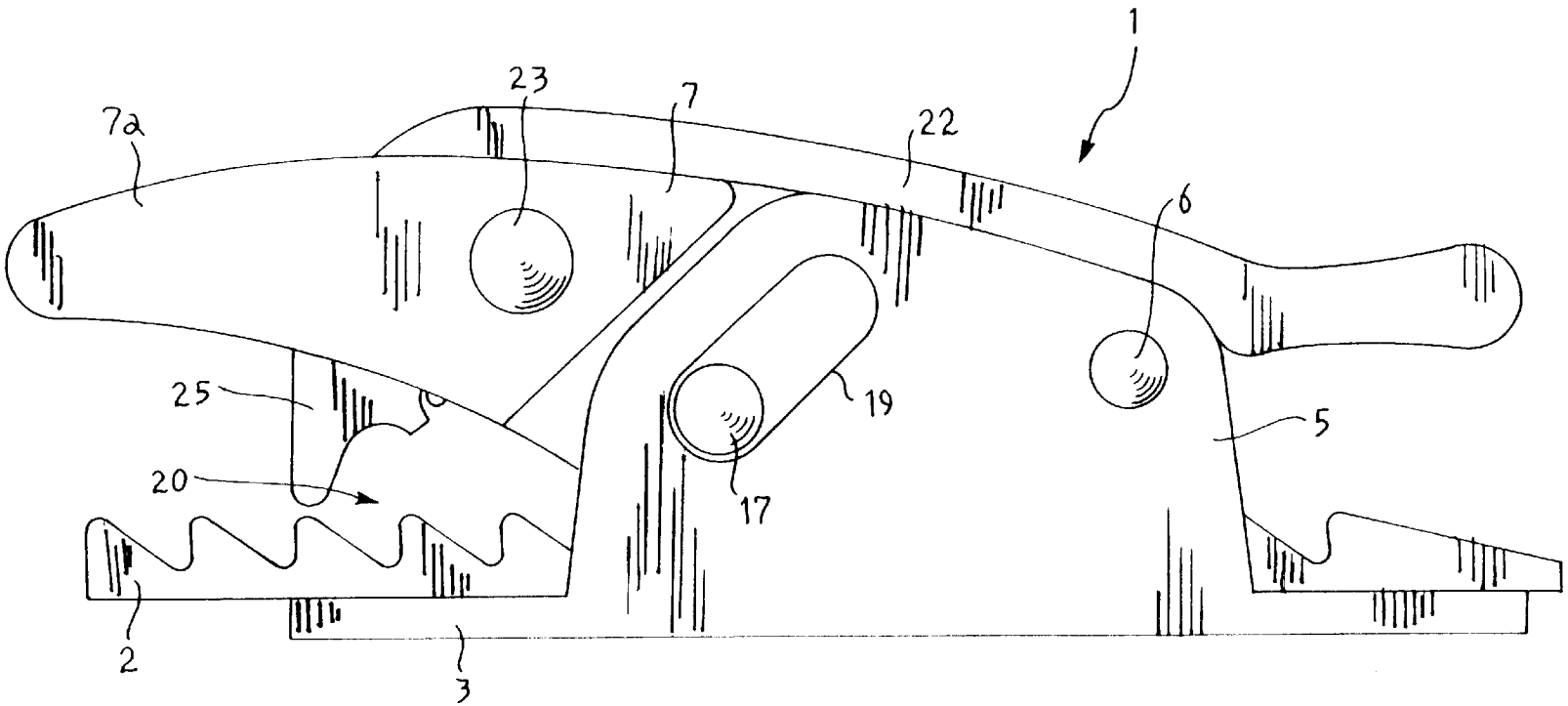
FIG. 1 is a side elevational view of an adjustment/clamping device according to the invention.

With reference to the aforementioned drawings, a tension-adjustment and clamping device for a toothed strap 2 or rack of a fastening for ski boots and similar sports footwear, generally of the type having an upper moulded from plastics material, is generally indicated 1.

The device 1 comprises a base 3 with shoulders 4 and 5 on opposite sides and is intended to be fixed to a flap of the upper by conventional means, not shown, for example, one or more rivets which engage respective holes 3*a* in the base 3.

A pin 6 is fixed to the shoulders 4, 5 and a first lever 7 is pivotable thereon.

Figure 4:
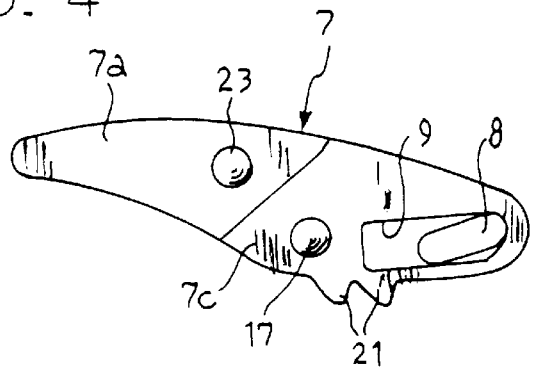
FIGS. 4, 5, 6, and 7 show, on a reduced scale, some details of the device of the invention illustrated in the preceding drawings.
Figure 5:
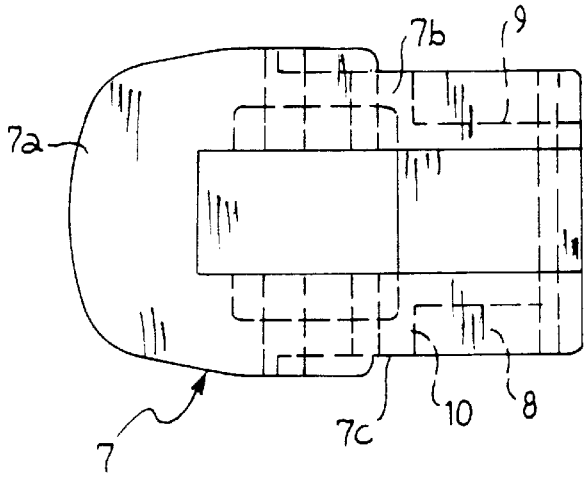

This lever 7 (FIGS. 4 and 5) has a substantially fork-like structure with identical, parallel arms 7*b*, 7*c* extending from an operating end (or grip) 7*a* of the lever.

A slot-like hole 8, by means of which the lever 7 is mounted for pivoting and sliding on the pin 6, extends through the arms 7*b*, 7*c*, close to their free ends. Owing to this engagement, the lever 7 is pivotable on the base 3 with a movable fulcrum (6–8) for guiding and limiting the travel between the lever 7 and the base 3.

Figure 2:
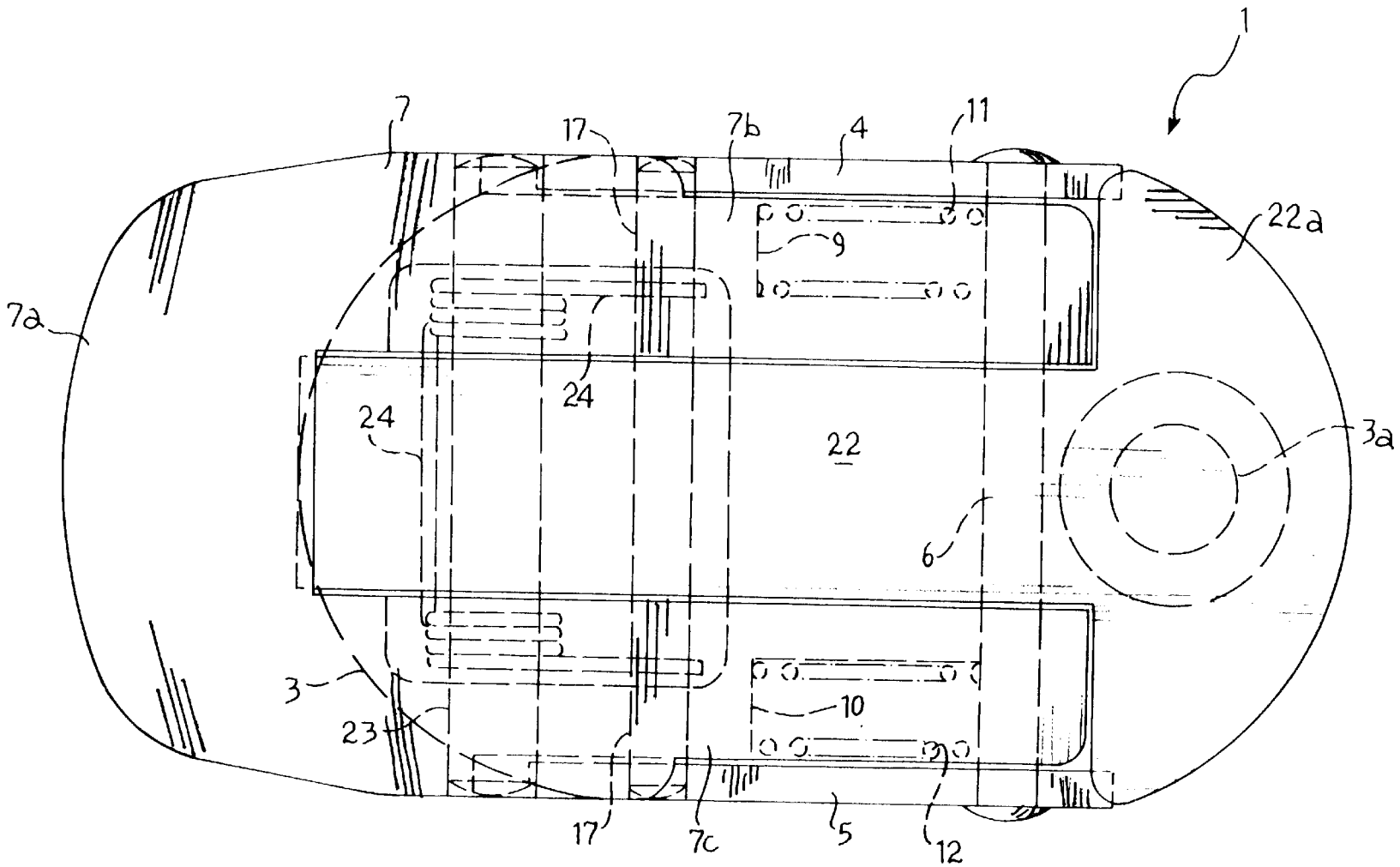
FIG. 2 shows the device of FIG. 1 in plan.

Respective seats 9, 10 (FIGS. 2 and 5) are formed in the arms 7*b*, 7*c* of the lever 7 for housing springs 11, 12.

Figure 3:
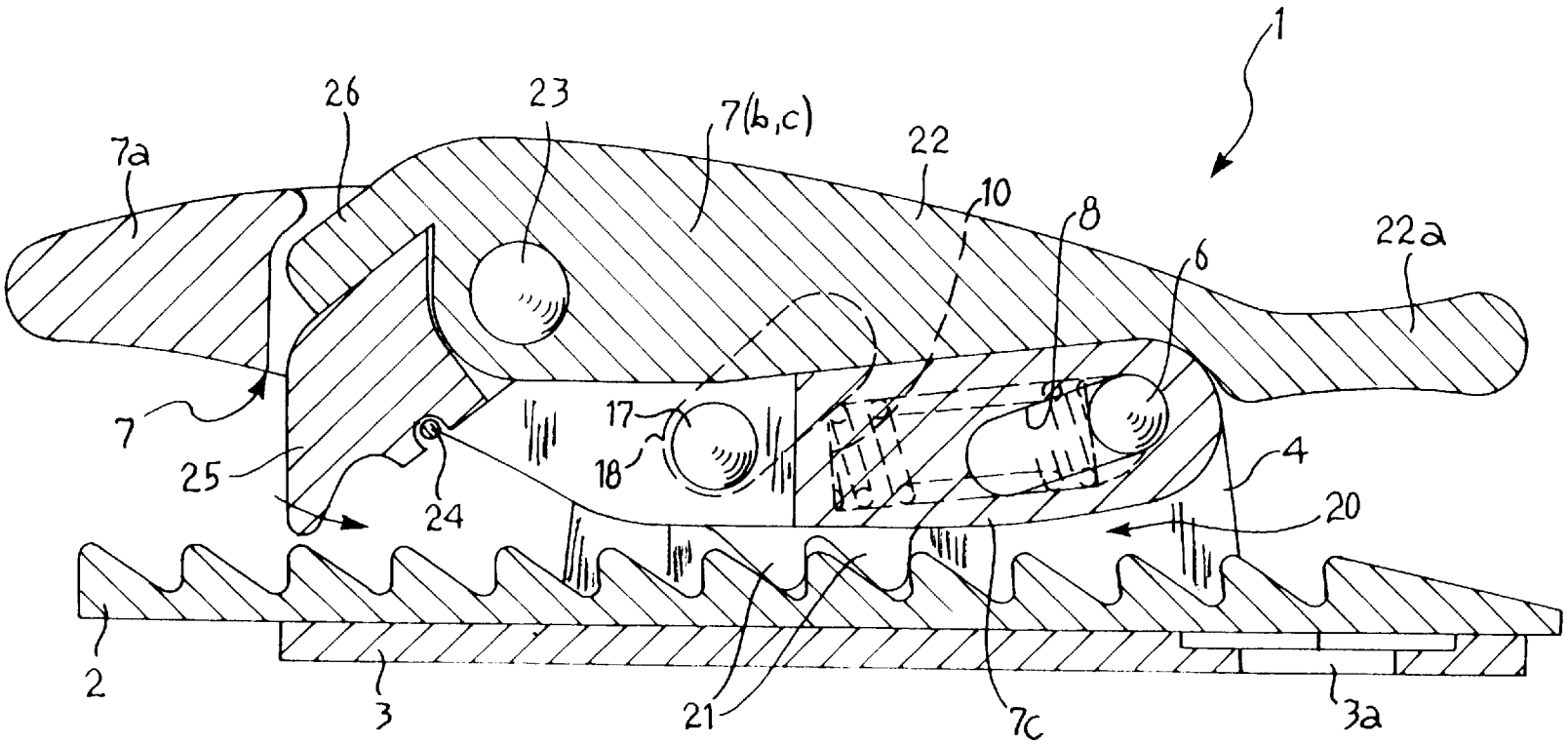
FIG. 3 shows the device of FIG. 1 in longitudinal section.

The latter bear at one end on the bases of the seats 9, 10 and at the other end on the pin 6. In normal conditions (FIG. 3), the springs 11, 12 consequently keep the lever 7 in the position in which the pin 6 is engaged by the ends of the slot-like hole 8 closest to the free ends of the arms 7*b*, 7*c* of the lever 7.

In an intermediate position, the lever 7 has a pin 17 extending parallel to the slot-like hole 8 and projecting from opposite sides of the lever. This pin 17 is engaged for rotating and sliding (FIGS. 1 and 2) in slot-like holes 18, 19 formed in the opposed shoulders 4, 5 of the base 3. The maximum extent of the angular movements of the lever 7 about the pin 6 depends on the length of the slot-like holes 18, 19 as well as on the movement permitted by the slot-like hole 8.

A passageway 20 for the toothed strap 2 is defined between the lever 7 and the base 3.

The lever 7 also has, in its wall facing the base 3, a pair of teeth 21, 21 for engaging the teeth of the strap 2, with which they are substantially equidirectional, so as to constitute the pawls of a ratchet mechanism for stopping the strap, as will become clear from the following description.

A second lever 22, the operating end or grip 22*a* of which has a semicircular profile in plan, is positioned between the arms 7*b*, 7*c* of the lever 7, extending outwardly at the free ends of the arms 7*b*, 7*c*.

The lever 22 is pivotable on a pin 23 supported by the arms 7*b*, 7*c* in a position outside the shoulders 4, 5 of the base 3.

A spring 24 wound on the pin 23 has one end bearing underneath one of the arms 7*b*, 7*c* and the other end bearing under an appendage 25 projecting from the front of the lever 22 and having a triangular profile for engaging the toothed strap 2 like a pawl.

The lever 22 and the respective pawl 25 constitute an "advancing ratchet mechanism" for the toothed strap 2, as will become clear from the following description.

According to a preferred embodiment, the pawl 25 is structurally independent of the respective lever 22.

Figure 6:
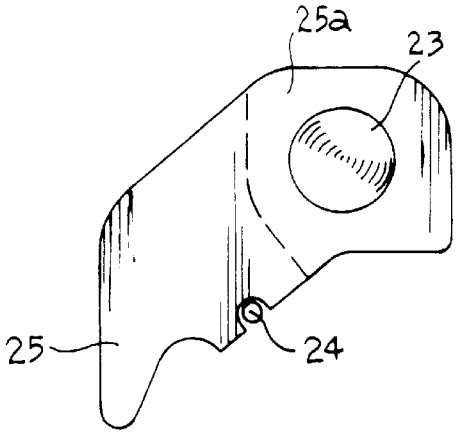
Figure 7:
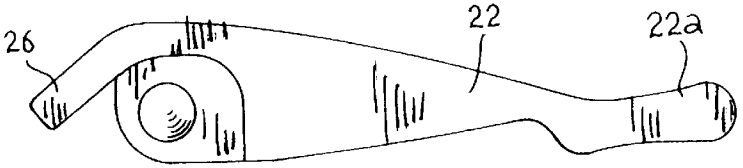

In this embodiment (FIGS. 3, 6 and 7), the lever 22 has a curved end portion 26 inclined towards the base 3, and the pawl 25 has a substantially handle-like portion 25*a* mounted rotatably on the pin 23. The spring 24 acts on the pawl 25, urging it against the inclined portion 26 of the lever 22 from below.

When the action of the spring 24 on the pawl 25 is predominant, the pawl 25 and the lever 22 essentially constitute a single unit.

Figure 8:
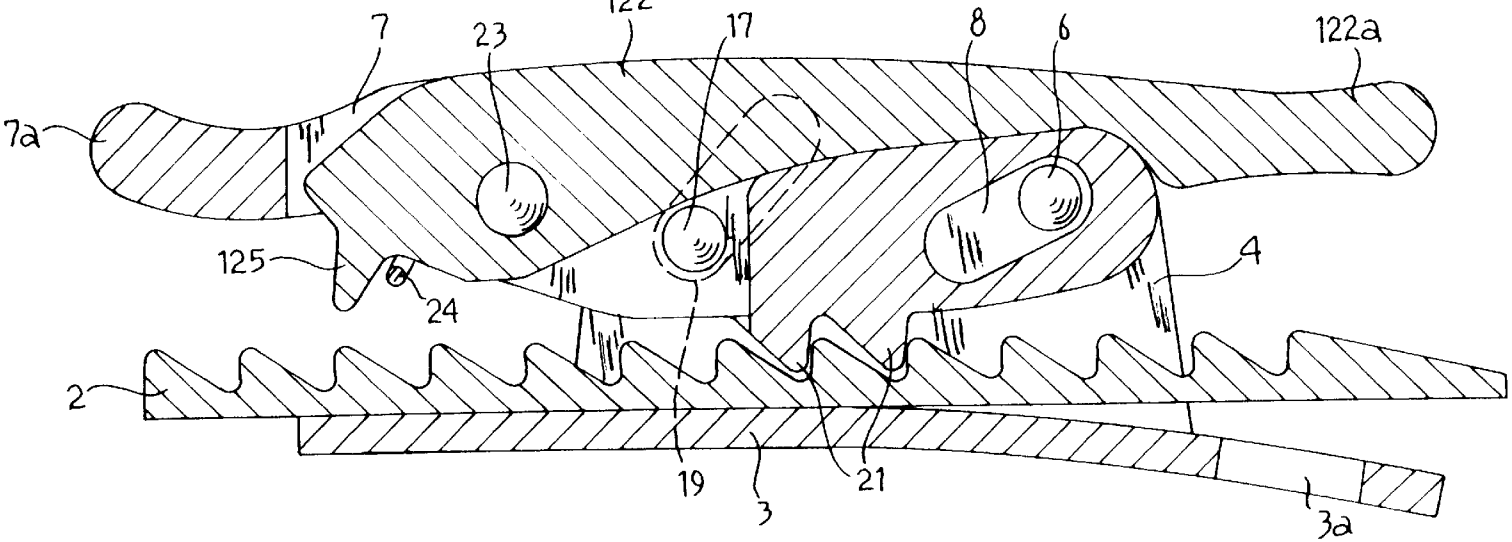
FIG. 8 shows a variant of the adjustment/clamping device of FIG. 1, in longitudinal section.

FIG. 8 shows a variant of the invention in which the ratchet mechanism for advancing the strap 2 is constituted by a lever 122 defining an integral pawl 125 projecting from its front end. The spring 24 acts on the lever 122.

Figure 12:
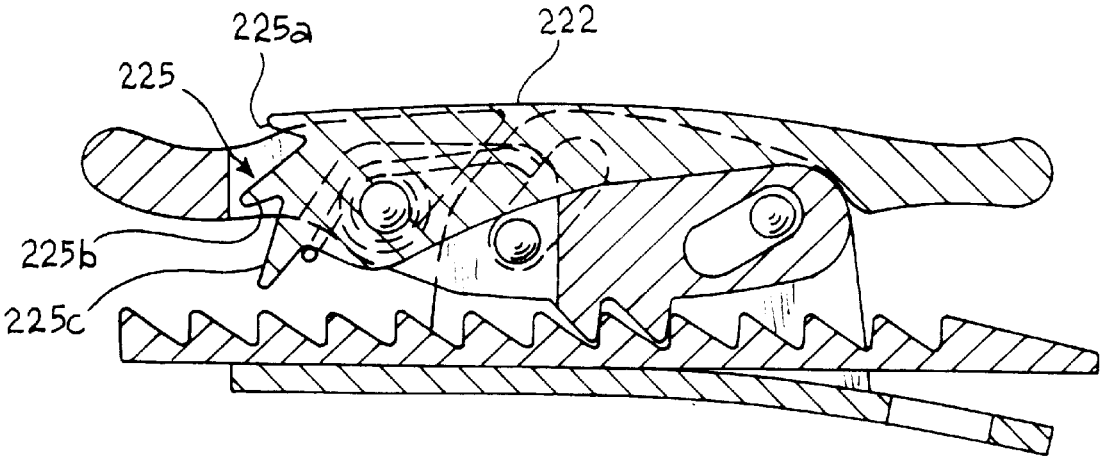
FIG. 12 is a side elevational view of a further variant of the adjustment and clamping device of FIG. 1.
Figure 13:
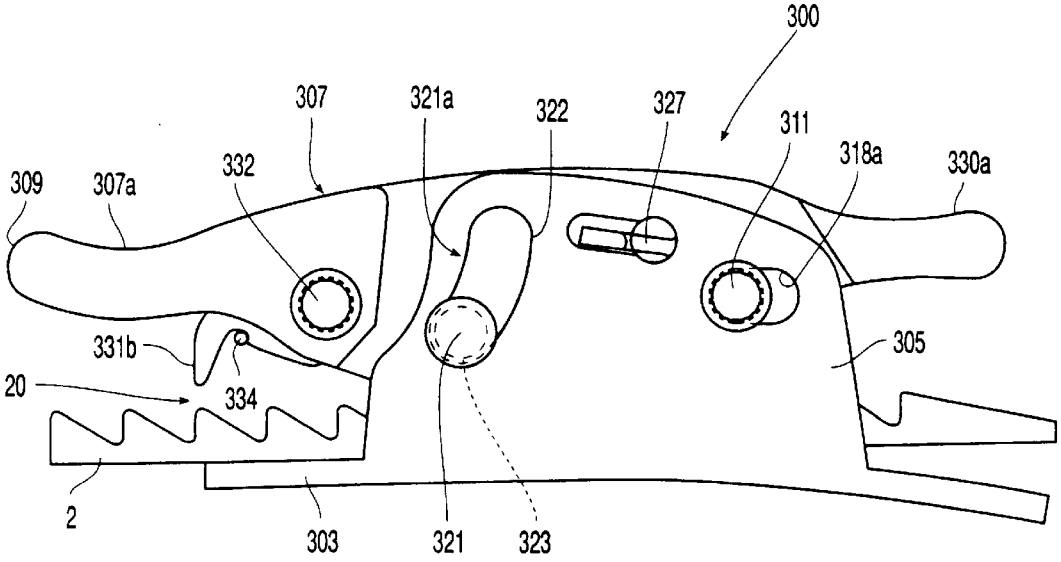
FIG. 13 is a side elevational view of a third variant of the device of the invention.
Figure 14:
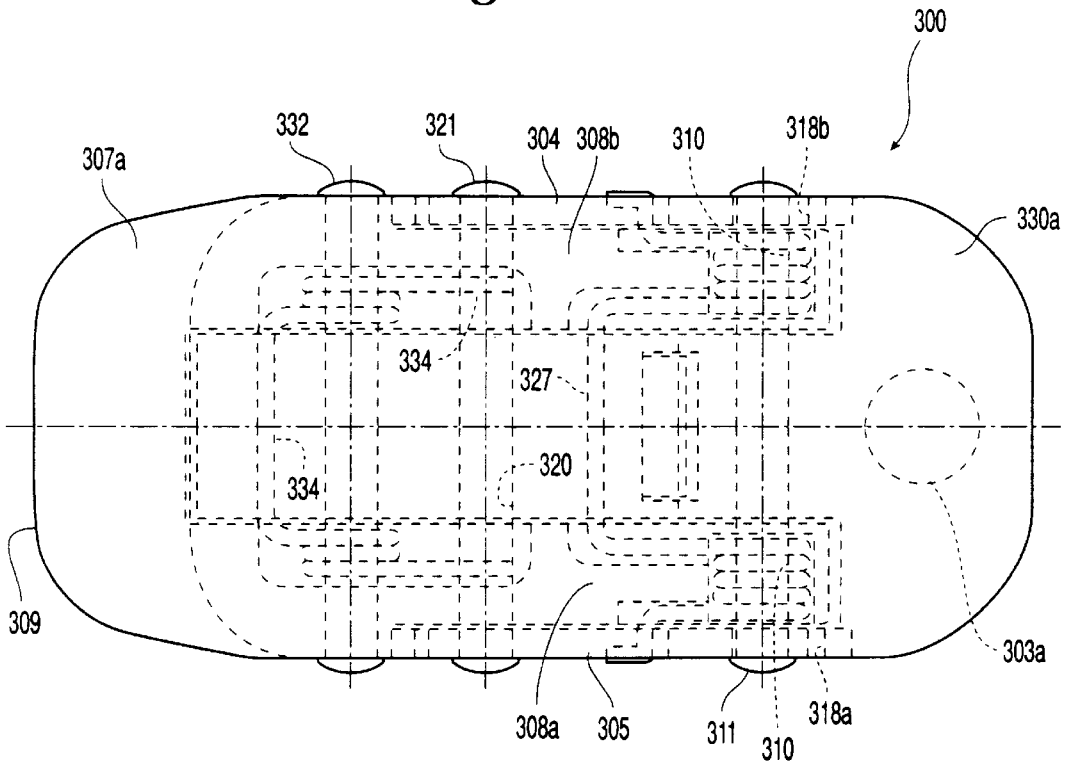
FIG. 14 shows the device of FIG. 13 in plan.

FIG. 12 shows a further variant of the invention in which the ratchet mechanism for advancing the strap 2 is constituted by a lever 222 defining an integral pawl 225 with three teeth 225*a*, 225*b*, 225*c*, projecting from the front end of the lever.

The adjustment/clamping device of the invention operates as follows.

In an initial condition of the device (FIG. 1), the toothed strap 2 is inserted through the passageway 20 defined by the levers 7, 22, by the base 3, and by the respective shoulders 4, 5.

As it passes through the passageway, the pawls 21 of the lever 7 (the stopping ratchet mechanism) do not obstruct the advance of the strap, even though they interfere with the teeth thereof, since these teeth and the aforesaid pawls are equidirectional and the lever 7 is free to move angularly about the pin 6.

When it has passed beyond the base 3, the strap 2 is gripped manually by the user and "pulled" as far as possible to achieve so-called fastening with rough tensioning.

When the strap 2 is released, it is clamped by the engagement of the pawls 21, 21 in the teeth of the strap.

At this point, the user can carry out fine adjustment of the degree of tensioning of the strap under load.

Figure 9:
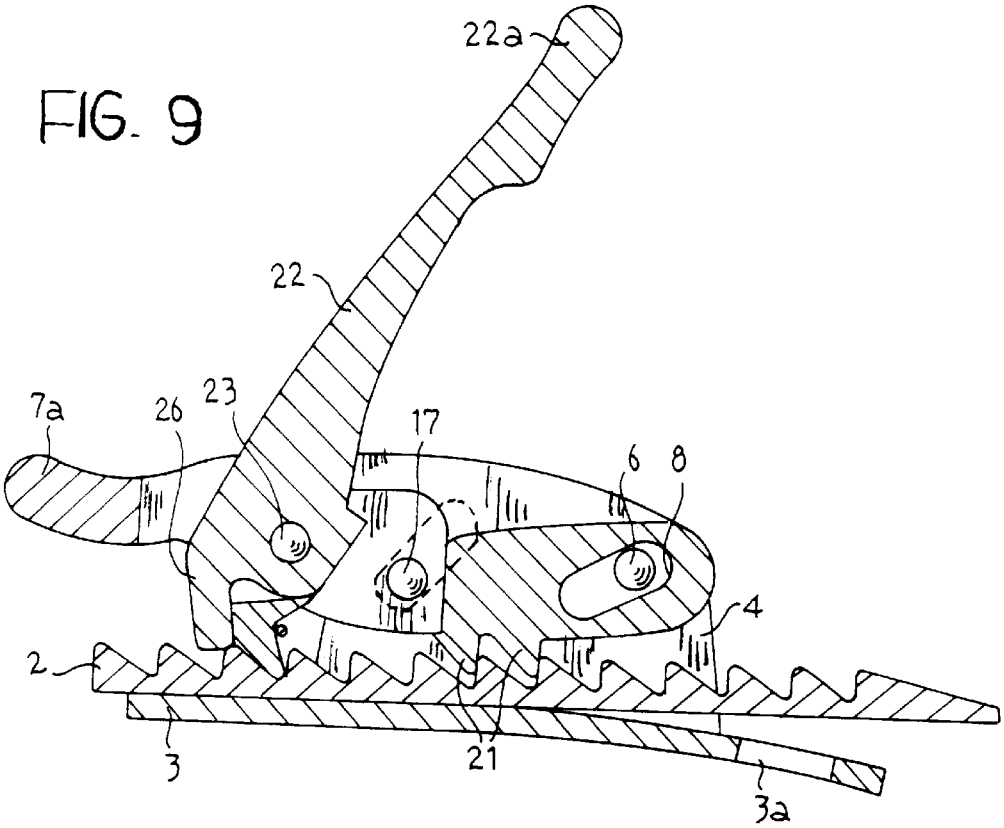
FIGS. 9, 10 and 11 show the device of FIG. 3 in longitudinal section, in various operative conditions.

For this purpose (FIGS. 9 and 10) the ratchet mechanism (22–25) for advancing the strap is operated. The lever 22 is gripped and is moved angularly about the pin 23 (anticlockwise with reference to the drawings) so that, initially, the pawl 25 is engaged between the teeth of the strap 2 (FIG. 9) and, subsequently, upon completion of the aforesaid angular movement, the strap is advanced through the passageway 20. As already stated, this advance is not obstructed by the stopping ratchet mechanism, the pawls 21 of which "skip" over tooth after tooth as long as the advance continues, that is, until the angular (anticlockwise) movement of the lever 22 is completed.

Figure 10:
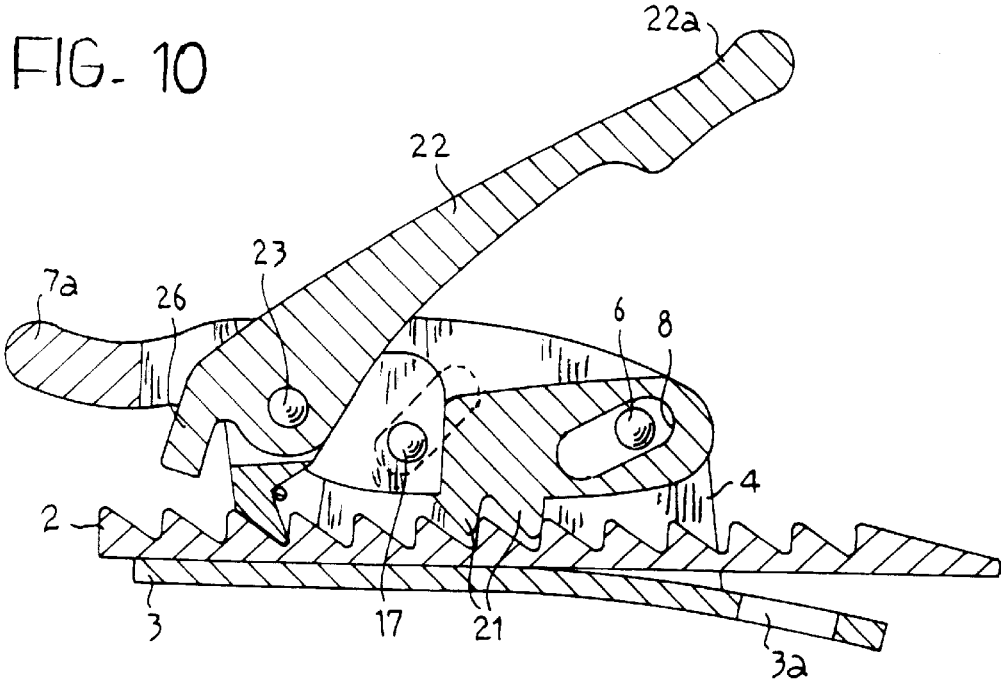
Figure 11:
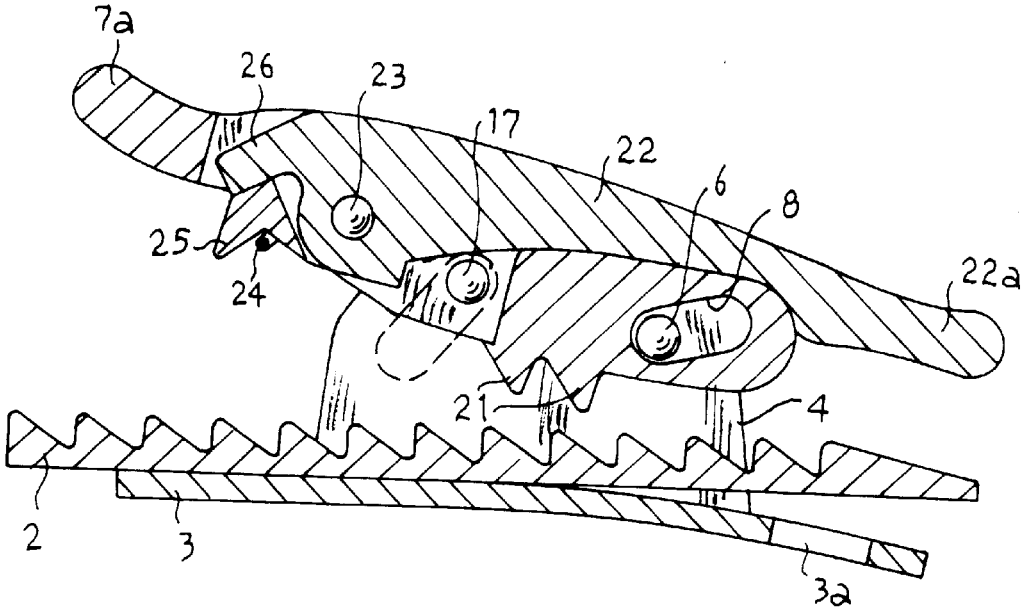

When the maximum possible angular movement has been reached, the lever 22 is lowered again (FIG. 10). Initially, the movement of the lever 22 is not followed by the respective pawl 25, which remains engaged between the teeth of the strap 2 in opposition to the spring 24. In this situation, the pawls 21 of the stopping ratchet mechanism engage the teeth of the strap 2 positively with a short delay after the lever 22 starts to be lowered, clamping it in the position reached. During the aforesaid short delay, the strap 2 performs a corresponding small rearward movement relative to the passageway 20, thus releasing the pawl 25 which is urged by the spring 24 back to its position against the curved appendage 26 of the lever 22, becoming a single unit therewith.

The desired degree of tensioning of the strap 2 is achieved by a number of angular movements of the lever 22, as described above.

To open the device of the invention quickly, allowing the strap to be withdrawn from the passageway 20 and thus "unfastening" the sports footwear, it suffices to move the lever 7 angularly about its movable fulcrum (pin 6/slot-like hole 8) in order to move the stopping and advancing ratchet mechanisms away from the base 3 simultaneously.

This angular movement of the lever 7 is permitted by the movement of the pin 6 along the respective slot-like hole 8 in opposition to the springs 11, 12, and by the sliding of the pin 17 in the slot-like holes 18 and 19.

With reference to FIGS. 13 to 17, a device for adjusting and clamping the strap 2 according to a third variant of the invention is generally indicated 300.

Details similar to those of the preceding embodiments are indicated by the same reference numerals.

The device 300 comprises a base 303 with shoulders 304, 305 on opposite sides and is intended to be fixed to a flap of the upper by means of rivets or similar means, not shown, which engage respective holes 303*a* in the base 303.

The device 300 differs from the preceding embodiments essentially in that the first lever 307 of the stopping ratchet mechanism is formed in two structurally independent portions, indicated 307*a*, 307*b*, respectively.

The first portion 307*a* has a substantially fork-like structure with identical, parallel arms 308*a*, 308*b* extending from an operating end (or grip) 309 of the lever.

A hole 310 extends through both of the arms 308*a*, 308*b* close to their free ends. The hole 310 houses a pin 311 by means of which the portion 307*a* is articulated to the base 303. The pin 310 in turn is engaged for rotating and sliding in slot-like holes 318*a*, 318*b* formed in the opposed shoulders 304, 305 of the base 303. Owing to this engagement, the portion 307*a* of the lever is pivotable on the base 303 with a movable fulcrum (311–318*a*, 318*b*).

The second portion 307*b* of the lever 307 has a passageway 320 for housing a pin 321 by means of which the portion 307*b* is articulated to the first portion 307*a*. The pin 321 is also engaged for sliding in slots 321*a*, 321*b* formed in the opposed shoulders 304, 305 of the base 303, respectively.

Each slot 321*a*, 321*b* comprises a first portion and a second portion, indicated 322, 323, respectively, one forming an extension of the other. The first portion 322 is substantially straight or curved but in any case permits free pivoting of the lever 307 about the axis of the pin 311, possibly facilitated by small translational movements of the pin 311 in the corresponding slot-like holes 318*a*, 318*b*.

The second portion 323 is oriented away from the pin 311 to constitute a kind of recess for housing the pin 321, as will be explained further below.

The second portion 307*b* of the lever 307 also has a tooth 324 in its wall facing the base 303 for engaging the homologous teeth of the strap 2 so as to constitute a pawl for stopping the strap.

An appendage 325 projecting from the second lever portion 307*b* is normally urged into abutment with a corresponding surface 326 of the first lever portion 307*a* by means of a spring 327 wound around the pin 311.

The spring 327 has one end restrained slidably in one of the shoulders 304, 305 and the other end housed in a recess 329 formed in the second portion 307*b* of the lever 307, beneath the appendage 325.

The ratchet mechanism for advancing the strap 2 is constituted by a second lever 330 defining an integral pawl 331 with two teeth 331*a*, 331*b* projecting from the front end of the lever.

The second lever 330 is pivotable on a pin 332 supported by the arms 308*a*, 308*b* of the lever 307 in a position outside the shoulders 304, 305 of the base 303. The lever 330 has an operating end or grip 330*a* having an essentially semicircular profile in plan, extending outwardly at the free ends of the arms 308*a*, 308*b*.

A spring 334 wound around the pin 332 has one end bearing beneath one of the arms 308*a*, 308*b* and the other end bearing beneath the pawl 331.

The device 300 of this third variant of the invention operates as follows.

With regard to the adjustment of the tensioning of the strap 2, the operation is exactly the same as that of the preceding embodiments.

In an initial condition of the device (FIG. 13), the toothed strap 2 is inserted through the passageway 20 defined by the levers 307, 330, by the base 303, and by the respective shoulders 304, 305.

As the strap passes through the passageway, the pawl 324 of the lever 307 (the stopping ratchet mechanism) does not obstruct the advance of the strap, even though it interferes with the teeth thereof, since these teeth and the pawl are equidirectional and the portion 307*b* of the lever 307 is free to move angularly about the pin 321 (anticlockwise).

When it has passed beyond the base 303, the strap 2 is gripped manually by the user and "pulled" as far as possible to achieve so-called fastening with rough tensioning.

When the strap 2 is released, it is clamped by the engagement of the pawl 324 in the teeth of the strap.

At this point, the user can carry out fine adjustment of the degree of tensioning of the strap under load.

For this purpose (FIG. 16), the ratchet mechanism (330–331) for advancing the strap is operated. The lever 330 is gripped and is moved angularly about the pin 332 (anticlockwise with reference to the drawings) so that, initially, the pawl 331 is engaged between the teeth of the strap 2 (FIG. 16) and, subsequently, upon completion of the aforesaid angular movement, the strap is advanced through the passageway 20. As already stated, this advance is not obstructed by the stopping ratchet mechanism, the pawl 324 of which "skips" over tooth after tooth as long as this advance continues, that is, until the angular (anticlockwise) movement of the lever 330 is completed.

Figure 15:
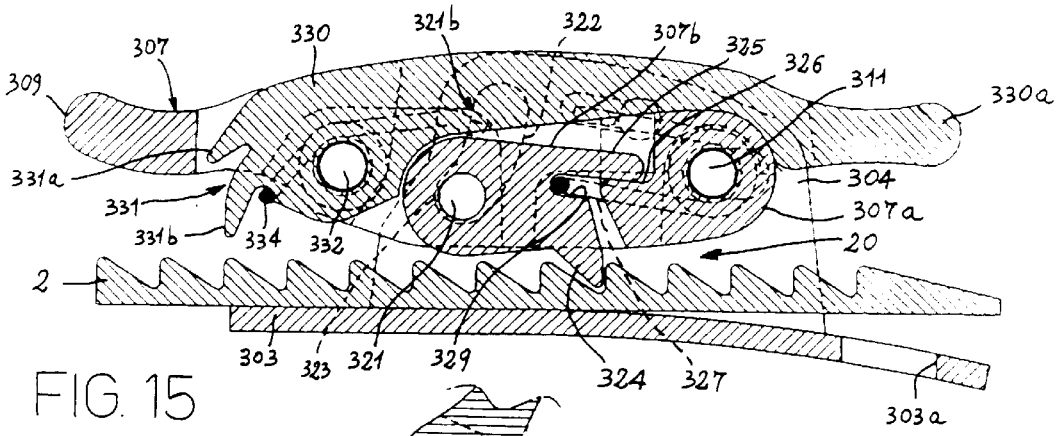
FIG. 15 shows the device of FIG. 13 in longitudinal section.
Figure 16:
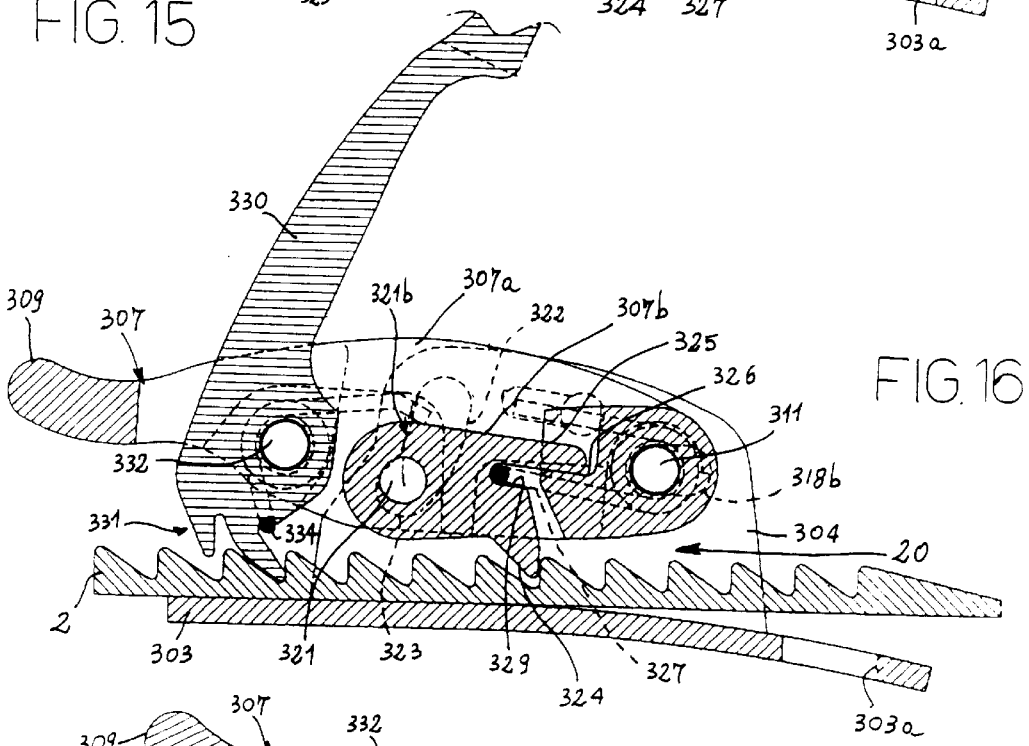
FIGS. 16 and 17 show the device of FIG. 13 in various operative conditions.
Figure 17:
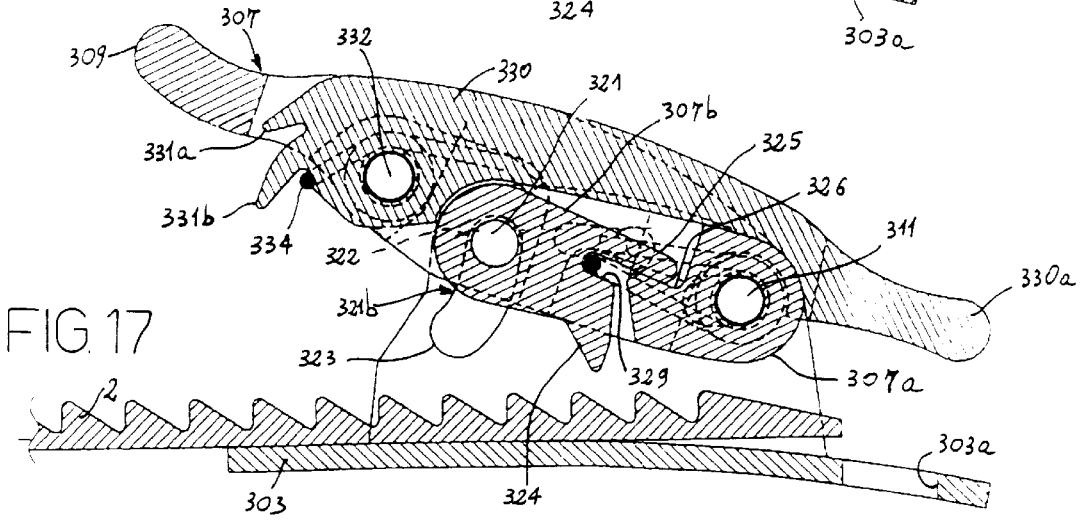

When the maximum possible angular movement has been reached, the lever 330 is lowered again (FIG. 15). The desired degree of tensioning of the strap 2 is achieved by a number of angular movements of the lever 330, as described above.

It will be noted that, in the position of FIG. 15, in which the strap 2 is clamped, the lever 307 is moved towards the left (as seen in FIG. 15) with the pin 311 in abutment with the corresponding end of the slot-like hole 318*a*, 318*b* as a result of the load exerted on the tooth 324 by the strap 2 under tension. The pin 321 is consequently housed in the recess 323 of the corresponding slot 321*a*, 321*b* thus preventing the lever 307 from rotating about the axis of the pin 311 and consequently releasing the tooth 324 from the teeth of the strap 2.

To open the device, allowing the strap to be withdrawn from the passageway 20 and thus "unfastening" the footwear, it suffices to move the portion 307*a* of the lever 307 angularly about the respective movable fulcrum (pin 311/slot-like hole 318*a*, 318*b*) to move the stopping and advancing ratchet mechanisms away from the base 303 simultaneously.

Upon a first operation of the lever 307 (clockwise with reference to FIG. 15), the pins 311, 321 are guided in a rotational-translational movement by the second portion of the slot 323 and by the slot-like hole 318*a*, 318*b*, respectively. When the pin 321 has passed over the point of the connection between the first and second slot portions 322, 323, it is guided by the first slot portion 322 with consequent pivoting of the lever 307 about the axis of the pin 311. The pin 311 is kept close to the end of the slotlike hole 318*a*, 318*b* farthest from the slot 321*a*, 321*b* (the right-hand abutment). The tooth 324 is completely disengaged from the strap 2 (FIG. 17) as a result of this angular movement of the lever 307. The shape and arrangement of the slots 321*a*, 321*b* and of the slot-like holes 318*a*, 318*b* is therefore selected in a manner such that, at least in a portion of the lifting travel, the lever 307 is guided in a purely rotational movement so as advantageously to reduce the frictional forces which, particularly when there is mud or earth on the fastening, may compromise correct operation of the device.

Figure 18:
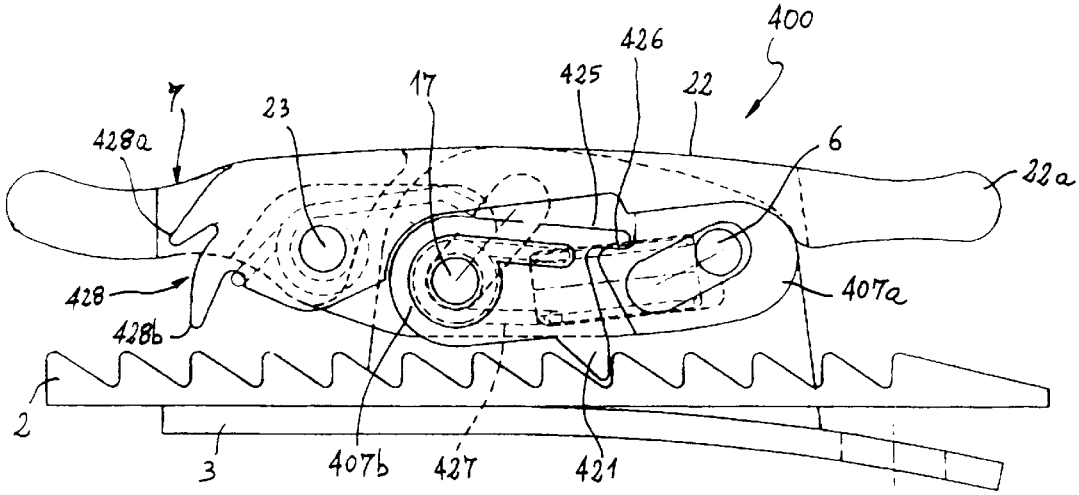
FIG. 18 is a side elevational view of a further variant of the device of FIG. 1.
Figure 19:
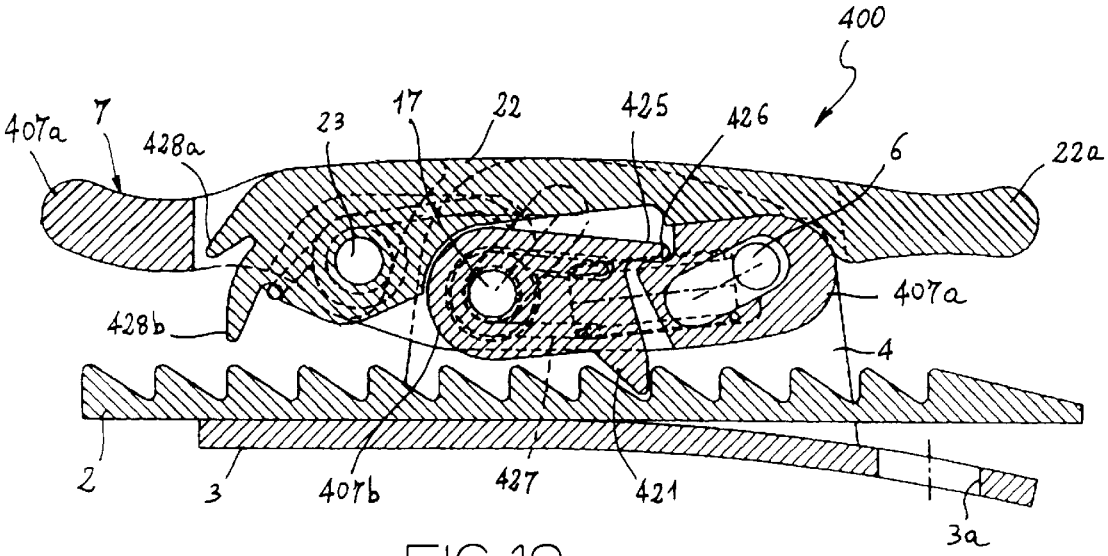
FIG. 19 shows the device of FIG. 18 in longitudinal section.

FIGS. 18 and 19 show a further variant of the device of FIG. 1, generally indicated 400. The device 400 differs from the device 100 in that the first lever 7 of the stopping ratchet mechanism is formed in two structurally independent portions 407*a*, 407*b*.

The first portion 407*a* is mounted for pivoting and sliding on the pin 6 with a movable fulcrum (6–8).

The second portion 407*b* is articulated to the first portion 407*a* about the pin 17. It has a tooth 421 for engaging the homologous teeth of the strap 2.

An appendage 425 projecting from the second lever portion 407*b* is normally urged into abutment with a corresponding surface 426 of the first lever portion by means of a spring 427 wound around the pin 17.

The second lever 22 of the stopping ratchet mechanism differs from the device 1 in that it comprises a pawl 428 defined integrally therewith, with two teeth 428*a*, 428*b* projecting from the front end of the lever.

The operation of the device 400 is exactly the same as that of the device 1 described above.

The invention thus devised may undergo variations and modifications all falling within the scope of the inventive concept as defined by the following claims.

What is claimed is:

1. A device for adjusting and clamping the toothed strap of a fastening for sports footwear, comprising a base, a ratchet mechanism for stopping the strap, and a ratchet mechanism for advancing the strap, the stopping ratchet mechanism comprising a first lever pivotable on the base for pivotal movement about a fulcrum and defining therewith a passageway for the strap, at least one tooth being provided on the first lever for engaging the teeth of the strap in order to constitute a stopping pawl of the stopping ratchet mechanism, the advancing ratchet mechanism comprising a second lever for engaging the teeth of the strap in order to advance the strap, characterized in that the second lever of the advancing ratchet mechanism is articulated to the first lever of the stopping ratchet mechanism for pivotal movement about a pin spaced from said fulcrum.

2. A device according to claim 1, in which the fulcrum of the first lever of the stopping ratchet mechanism is movable relative to the base.

3. A device according to claim 2, in which the fulcrum of the first lever is constituted by the engagement of a pin and a slot-like hole provided, respectively, on the base and on the lever, the pin being movable perpendicularly to its axis in the slot-like hole in opposition to spring means.

4. A device according to claim 1, in which the second lever comprises a pawl at an opposite end thereof to the axis of articulation to the first lever.

5. A device according to claim 4, in which the pawl is integral with the second lever.

6. A device according to claim 4, in which the pawl can pivot in one direction on the second lever in opposition to spring means.

7. A device according to claim 1, comprising means for guiding and limiting the travel between the first lever and the base.

8. A fastening for ski boots and similar sports footwear with a device for adjusting the tensioning of a toothed strap and for clamping the strap in a passageway defined in a base for anchoring the device to a ski boot, characterised in that the device comprises:

a) a ratchet mechanism for stopping the strap in the passageway, including
   - a first lever having an operating end, its other end being pivotable with a movable fulcrum on shoulders of the base,
   - at least one pawl projecting from the lever towards the base,
   - means for guiding and limiting the angular movements of the first lever about the fulcrum, b) a ratchet mechanism for advancing the strap through the passageway, including
   - a second lever pivotable on the first lever close to the operating end thereof and having a respective operating end outside of the movable fulcrum of the first lever,
   - a pawl projecting from the second lever towards the base.

9. A ski-boot fastening according to claim 8, characterized in that the means for limiting the angular movements of the first lever about the movable fulcrum comprise a pin supported by the first lever and engaged in slot-like holes formed on the opposed shoulders of the base.

10. A ski-boot fastening according to claim 8, characterized in that the movable fulcrum comprises a slot-like hole which is formed transversely in the lever and in which a pin, supported by the opposed shoulders of the base, is engaged.

11. A fastening according to claim 10, characterized in that the movements of the pin of the movable fulcrum relative to the slot-like hole take place in opposition to resilient means.

12. A ski-boot fastening according to claim 8, characterized in that the pawl of the ratchet mechanism for advancing the strap is structurally independent of the respective second lever and is mounted for pivoting on a pin carried by the first lever and constituting the fulcrum of the second lever.

13. A ski-boot fastening according to claim 12, characterized in that the second lever comprises, in the vicinity of the pawl, a curved end portion inclined towards the base, resilient means being provided to keep the pawl in contact with the end portion of the second lever.

14. A ski-boot fastening according to claim 8, characterized in that the first lever has a fork-like structure with parallel arms having free ends pivotable on the opposed shoulders of the base, and in that the second lever extends between the arms.

15. A device according to claim 1, in which the first lever comprises a first portion articulated for rotation-translation relative to the base and a second portion pivotable on the first portion in opposition to spring means.

16. A device according to claim 15, in which the stopping ratchet mechanism comprises a first slot-like hole for housing a first pin by which the first lever is articulated, at one of its ends, to the base, and a second slot for housing a second pin by which the second portion is articulated to the first portion, the slot including adjacent first and second portions, the first portion extending substantially along the path of the second pin during the pivoting of the lever about the first pin, the second portion extending so as to define a recess for housing the second pin in order to resist rotation of the lever about the first pin when the stopping ratchet mechanism is under load.

17. A device according to claim 16, in which the second portion of the slot extends away from the first slot-like hole.

* * * * *